US006655272B2

(12) United States Patent
Hauck et al.

(10) Patent No.: US 6,655,272 B2
(45) Date of Patent: Dec. 2, 2003

(54) DAMPENING CONTROL METHOD TAKING ACCOUNT OF A PLURALITY OF VARIABLES THAT INFLUENCE THE PRINTING PROCESS

(75) Inventors: Axel Hauck, Karlsruhe (DE); Nikolaus Pfeiffer, Dover, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/994,203

(22) Filed: Nov. 26, 2001

(65) Prior Publication Data

US 2002/0096076 A1 Jul. 25, 2002

(30) Foreign Application Priority Data

Nov. 24, 2000 (DE) ..... 100 58 573

(51) Int. Cl.[7] ..... B41F 7/24; B41L 25/00
(52) U.S. Cl. ..... 101/148; 101/484
(58) Field of Search ..... 101/147, 148, 101/450.1, 484, DIG. 45

(56) References Cited

U.S. PATENT DOCUMENTS

| | | | | | |
|---|---|---|---|---|---|
| 4,146,474 | A | * | 3/1979 | Kagatani | 101/147 |
| 4,872,406 | A | * | 10/1989 | Kusch | 101/148 |
| 4,892,035 | A | * | 1/1990 | Terzuolo | 101/148 |
| 4,899,653 | A | * | 2/1990 | Michl et al. | 101/148 |
| 4,972,774 | A | * | 11/1990 | MacPhee | 101/148 |
| 5,038,681 | A | * | 8/1991 | Hultberg et al. | 101/484 |
| 5,050,994 | A | * | 9/1991 | Kipphan et al. | 356/445 |
| 5,090,316 | A | * | 2/1992 | Rodi et al. | 101/148 |
| 5,368,817 | A | * | 11/1994 | Sudo et al. | 422/62 |
| 5,520,113 | A | * | 5/1996 | Joss et al. | 101/484 |
| 5,592,880 | A | * | 1/1997 | Rodi | 101/450.1 |
| 5,791,249 | A | * | 8/1998 | Quadracci et al. | 101/450.1 |
| 5,884,558 | A | * | 3/1999 | Nakamura et al. | 101/148 |
| 6,029,577 | A | * | 2/2000 | Fukuoka et al. | 101/148 |
| 6,138,563 | A | * | 10/2000 | Sone et al. | 101/147 |
| 6,257,144 | B1 | * | 7/2001 | Erhardt et al. | 101/148 |

FOREIGN PATENT DOCUMENTS

| | | |
|---|---|---|
| DE | 38 30 732 C2 | 3/1990 |
| DE | 40 28 083 A 1 | 3/1992 |
| DE | 41 22 794 A 1 | 1/1993 |
| DE | 197 01 219 A 1 | 7/1998 |
| JP | 05-330009 | * 12/1993 |

OTHER PUBLICATIONS

Wolfgang Tietze: Probleme des Farbe–Feuchtmittel–Verhältnisses im Offsetdruck (Problems of the Ink –Dampening Medium Ratio during the Offset Printing Process), Papier und Druck 22, 1973 2, pp. 17–21.

* cited by examiner

*Primary Examiner*—Stephen R. Funk
(74) *Attorney, Agent, or Firm*—Laurence A. Greenberg; Werner H. Stemer; Gregory L. Mayback

(57) ABSTRACT

The method effects a closed-loop control of the quantity of dampening solution during printing. The metering of the quantity of dampening solution to be applied to the printing material is preferably a function of the printing speed. In addition, at least one of the variables that influence the requisite quantity of dampening solution in the printing process is taken into account.

5 Claims, 1 Drawing Sheet

DAMPENING CONTROL METHOD TAKING ACCOUNT OF A PLURALITY OF VARIABLES THAT INFLUENCE THE PRINTING PROCESS

BACKGROUND OF THE INVENTION

FIELD OF THE INVENTION

The invention relates to a method for the closed-loop control of the quantity of dampening solution during printing, in which the metering of the quantity of dampening solution to be applied to the printing material is preferably selected as a function of the printing speed.

Methods for the closed-loop control of the metering of dampening solution, in particular during offset printing, on the basis of the measured quantity of dampening solution, for example on the printing plate having ink-free and printed areas, are known. In this case, the measured variable used is, for example, the layer thickness of the dampening solution, measured by infrared absorption, the gloss of the printing-plate surface, which changes with increasing layer thickness, or the like.

U.S. Pat. No. 5,050,994 (German patent DE 38 30 732 C2) discloses a method of supplying a dampening solution in an offset printing machine. There, using an opto-electronic converter, measured brightness values are obtained from a printed original having ink-free and printed areas, and in which the measured brightness values are used to derive signals for actuating elements with the aid of which the quantity of dampening solution supplied to a printing plate is led to a desired value. According to the method, the signals produced by scanning the areas lying behind the edges of the predefined inked areas are compared with comparative values. Depending on the result of the comparison, a dampening deficiency signal is derived, which identifies an excessively low dampening solution feed. The scanning can preferably be carried out on a printed sheet but scanning on the rubber blanket or on the printing plate clamped in is not ruled out.

German patent application DE 197 01 219 A1 discloses a method for the open-loop control of the inking during printing, in which the metering of the fluid to be applied to a printing material is varied as a function of the printing speed, and in the event of a change in the printing speed, the fluid is applied in controlled excess for some time at the same time as the change in the printing speed.

German patent application DE 41 22 794 A1 discloses a method for the monitoring and closed-loop control of the printing process, in particular on offset printing machines, in which, for example, tonal value gains are not controlled exclusively by varying the ink feed. The method according to the invention is in this case organized into a learning and a doing phase. The quality features which can be registered on the printed product by measurement form a feature space in which membership vectors from printing trials selected in accordance with the method are assigned to specific classes and/or causes for printing disruptions (learning phase). In the doing phase, that is to say the closed-loop control and monitoring of the printing process, an indication is given on the basis of the determined membership of the class and/or the cause of the printing disruption in this class, and/or precisely via the cause determined in this way, action is taken in the process with the objective of eliminating this cause.

The fundamental objective of the printing process is the optimum transfer of ink in the printing area of the plate and keeping it free in the non-printing area. In manual terms, this state is adjusted by moving to the so-called smearing limit, that is to say the start of scumming, and slight overdampening, usually 10%. However, there is no method for the on-line registration by measurement of the state relating to the smearing limit. In order nevertheless to be able to implement dampening solution closed-loop control, the variable which is indirectly related thereto, the dampening film thickness or the like, is measured and regulated via the dampening solution metering. In general, the quality of closed-loop control is restricted considerably and is inadequate.

However, the ink-water balance as referred to the entire process is critical for the quality of the printed image. In this case, in addition to the quantity of dampening solution on the plate or the printed original, the proportion of water in the ink and the surface water on the applicator rolls in particular play an important part.

SUMMARY OF THE INVENTION

It is accordingly an object of the invention to provide a method of controlling the dampening in a printing unit, which overcomes the above-mentioned disadvantages of the heretofore-known devices and methods of this general type and which provides for closed-loop control in which a deficiency of dampening solution and an excess of dampening solution are controlled out, taking account of the ink-water balance as refers to the entire process.

With the foregoing and other objects in view there is provided, in accordance with the invention, a method for the closed-loop control of a quantity of dampening solution in a printing process, which comprises:

metering a quantity of dampening solution to be applied to a printing material in the printing process and adjusting the quantity in dependence on a first variable (preferably the printing speed);

in addition to the first variable, taking into account at least one further variable influencing the requisite quantity of dampening solution in the printing process in the form of a set-point change $\Delta W$ as an input parameter for a dampening-solution controller.

In accordance with an added feature of the invention, the at least one variable that influences the printing process is selected from the group of the printing speed, the temperature of an inking unit, the temperature of an ink fountain, the temperature of the ink, the type and the state of the printing plate, the number of prints made, the ink density, the elapsed printing time, the water absorption capacity of the ink, the concentration of dampening solution additives, and the ink strip width.

In accordance with an additional feature of the invention, the (at least one) further variable influencing the quantity of dampening solution in the printing process is defined with a measurement during the printing process, i.e., the variable is a real-time variable.

In accordance with a concomitant feature of the invention, the set-point change $\Delta W$ is defined as a polynomial expression in n variables up to an order q. The numbers n and q are natural numbers, and n specifies the number of variables being taken into account.

The ink-water balance is influenced by various factors. In addition to the printing speed, the set of influencing variables includes the printing speed, the temperature of the inking unit, the temperature of the ink fountain, the temperature of the ink, the type and the state of the printing plate, the number of prints already made with the present printing plate, the ink density, the elapsed printing time, the water absorption capacity of the ink, the concentration of the dampening solution additives. These influencing variables can to some extent be measured very easily or are already present as variables in the machine control system. The method according to the invention for the closed-loop control of the quantity of dampening solution during printing, in which the metering of the quantity of dampening solution to be applied to the printing material is preferably selected as a function of the printing speed, comprises taking account of at least one variable that influences the requisite quantity of dampening solution in the printing process. In this case these may be in particular variables that influence the printing process from the set of different influencing factors indicated above. In particular, the dampening solution metering can be varied when there is a variation in the printing speed. For the measured quantity of dampening solution Y, for a predefined, substantially fixed set of influencing factors, that is to say certain parameters, a set point W is predefined and the inclusion of the relevant influencing factors, that is to say taking account of the deviations or variations of relevant influencing factors in relation to the respectively corresponding values in the predefined, substantially fixed set of influencing factors for the set point W, is carried out in the form of a set-point change ΔW In this case, the set-point change is a function of the n variables that are taken into account and influence the quantity of dampening solution in the printing process, n being a natural number, in addition to the actual quantity of dampening solution. The functional relationship for the set-point change ΔW can advantageously be represented around the point of the set point W, in other words an operating point, as a series expansion up to an order q, with q taken from the natural numbers. In the simplest case, the set-point change ΔW can be described as a linear polynomial, that is to say an expression of first order, in the form $$\Delta W = A_0 + (A_1 \times Z_1) + (A_2 \times Z_2) + \ldots + (A_{n \times Zn})$$

where the variables $Z_i$, i=1, . . . , n, n being a natural number, describe the n influencing factors and are to be understood as deviations from the value at the operating point, and $A_0$ and $A_i$, i=1, . . . , n are constant coefficients. In general, the coefficients can be determined by means of printing trials or calculation on the basis of an appropriate model. More complex relationships, in particular in the event of interaction between the individual variables, can if necessary be taken into account by a polynomial expression of higher order or a similar mathematical relationship. As an example in one advantageous embodiment of the invention mention should be made of the quadratic polynomial expression, that is to say of second order, $$\Delta W = A_0 + \sum_{i=1}^{n} A_i \times Z_i + \sum_{j,k=1}^{n} A_{jk} \times Z_j \times Z_k$$

where $A_0$, $A_i$ and $A_{jk}$, i, j, k=1, . . . , n are constant coefficients. In particular for the linear case, the printing speed, the temperature and the ink density, that is to say dampening solution tracking in the event of an inking change, can be taken into account. For the case of a higher order than a first order, it should be ensured that the series expansion in the n influencing factors converges, and that the expansion is consistent in all the variables $Z_i$, i=1, . . . n taken into account.

The method according to the invention has significant advantages. As a result of registering by measurement different variables that influence the quantity of dampening solution in the printing process, that is to say the ink-water balance, on-line registration of the margin from the smearing limit is made possible, so that input parameters for a closed-loop control system can be made available. The control quality can be increased. Since, for substantial parameter ranges, there is a linear relationship between the quantity of dampening solution and at least one of the variables that influence it, it is possible to have recourse to the standard methods for multi-parameter control systems which are known from control engineering. For example, such standard methods are described by H. Unbehauen "Regelungstechnik II" [Control Engineering II], Vieweg Verlag, Brunswick/Wiesbaden 1997. Advantageously, in a development of the invention, a distinction can be drawn between variables that have a high and low influence on the quantity of dampening solution in the printing process whose corrections can be taken into account up to different orders even in each case independently of one another.

Other features which are considered as characteristic for the invention are set forth in the appended claims.

Although the invention is illustrated and described herein as embodied in a dampening control method taking into account several variables influencing the printing process, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawing.

BRIEF DESCRIPTION OF THE DRAWING

The sole FIGURE of the drawing is a block diagram showing the control loop that takes account of a plurality of variables that influence the printing process.

DESCRIPTION OF THE PREFERRED EMBODIMENTS

Figure 1:
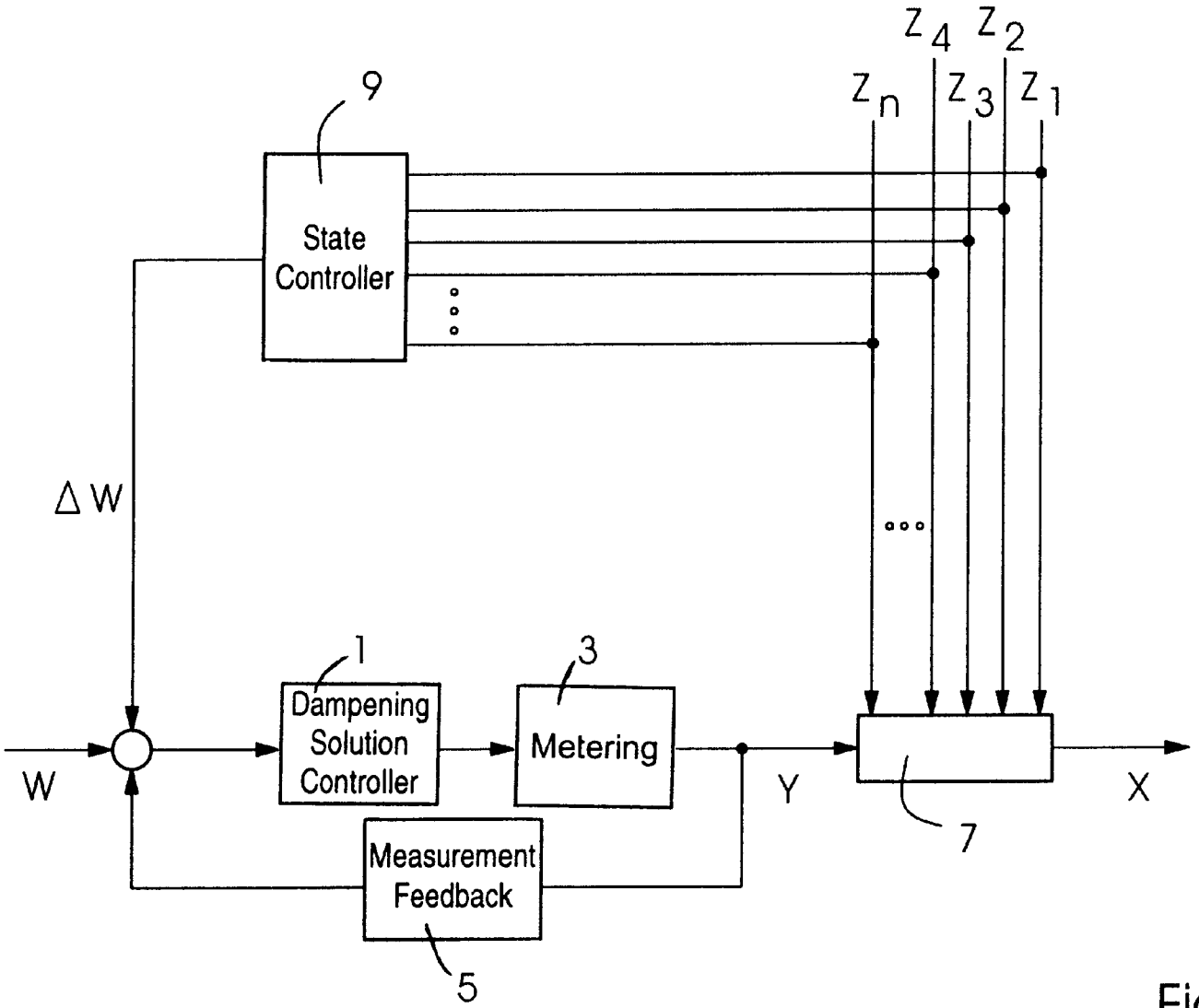

Referring now to the sole FIGURE of the drawing in detail, there is seen, in schematic form, a control loop taking account of a plurality of variables that influence the printing process. In a preferred embodiment of the invention, the input to a dampening solution controller 1 is influenced by at least three parameters. They are, in this case, a set point W, a set-point change ΔW, and a correction, which is obtained from the result of a measurement 5 of the quantity of dampening solution, the manipulated variable Y. The dampening solution controller 1 influences the dampening solution metering 3, in order to control out a deficiency or excess of dampening solution. The manipulated variable Y is therefore the quantity of dampening solution which is used as an input for the controlled section 7, that is to say the state of the ink-water balance. The controlled variable X is therefore the margin from the smearing limit.

The ink-water balance is influenced by various factors, that is to say variables that determine the quantity of dampening solution in the printing process. In the FIGURE, this fact is taken into account schematically by the arrows designated by $Z_1$ to $Z_n$. As already mentioned above, the various variables that influence the quantity of dampening solution in the printing process include the printing speed, the temperature of the inking unit, the temperature of the ink fountain, the temperature of the ink, the type and the state of the printing plate, the number of prints made, the ink density, the elapsed printing time, the water absorption capacity of the ink, the concentration of various dampening solution additives, the ink strip width, and the like. In the closed-loop control system according to the invention, provision is made for input values for a state controller 9 to be provided by means of measurements and/or predefinition of variables present in the machine control system. The input values represent or describe the influence of the corresponding variables on the state of the ink-water balance. With the aid of suitable modeling, for example disturbance variable feed forward or a polynomial expression, a set-point change ΔW is determined which, as already described above, functions as a parameter of the input to the dampening solution controller 1. The set point W for the closed-loop control can be predefined, for example, via absolute values or from the acceptable state which is associated with the printing process.

The method according to the invention for the closed-loop control of the quantity of dampening solution during printing can in principle also be used if, instead of the quantity of dampening solution on the plate or on a printed original, other variables, such as the proportion of dampening solution in the ink or the layer thickness of the surface water on at least one of the applicator rolls is measured. Furthermore, the method according to the invention is independent of the actual modeling for determining the set-point change ΔW On the basis of a suitable model, which comprises the important influencing factors which vary the quantity of dampening solution in the printing process, manual interventions by the machine operator can be minimized and the waste which accumulates until optimal process parameters are reached can be reduced.

In an advantageous development of the invention, tracking the quantity of dampening solution in the case of dynamically critical influencing variables can be configured in such a way that a controller with a differential component is used.

In the following text, an example of possible determination of the parameters for the method according to the invention for the closed-loop control of the quantity of dampening solution for the set-point change ΔW is to be given, using two variables that influence the quantity of dampening solution in the printing process. In the general case, from preliminary trials and/or theoretical considerations, it is possible to determine which influencing variables have to be taken into account. For those skilled in the art, an expansion from 2 to n parameters results by simple analogy.

From trials, it is known that the quantity of dampening solution depends on the temperature T and on the printing speed D. In order to take account in each case of a variable that influences the quantity of dampening solution in the printing process, typically a quadratic expression for the set-point change ΔW of the form $$\Delta W = A_{0T} + A_{1T} \times T + A_{2T} \times T^2$$

or $$\Delta W = A_{0D} + A_{1D} \times D + A_{2D} D^2$$

is sufficient, $A_{0T}$, $A_{1T}$, $A_{2T}$ and, respectively, $A_{0D}$, $A_{1D}$, $A_{2D}$ being constant coefficients. As an overall expression, the relationship $$\Delta W = A_0 + A_{1T} \times T + A_{2T} \times T \times T + A_{1D} \times D \times A_{2D} \times D \times D + A_{1TD} \times T \times D$$

can be developed from the expressions cited above, where $A_0$ and $A_{1TD}$ are also constant coefficients. Then, on the basis of preliminary trials or on an analytical basis, this general expression can be restricted. For example, over a wide parameter range, the quantity of dampening solution depends only linearly on the printing speed D, so that it is true that $$A_{2D} = 0.$$

For the remaining expression $$\Delta W = A_0 + A_{1T} \times T + A_{2T} \times T \times T + A_{1D} \times D + A_{1TD} \times T \times D$$

the further parameters $A_0$, $A_{1T}$, $A_{2T}$, $A_{1D}$ and $A_{1TD}$ are then determined by means of printing trials or an analytical model or a mixture of the two. For example, an experimental determination of the parameters $A_{1T}$ and $A_{2T}$ associated with the temperature can be carried out. For this purpose, the temperature is varied and the quantity of dampening solution is tracked. From the recorded measured values, the relationship between temperature and quantity of dampening solution can be determined, for example with the aid of regression analysis. As an alternative to this, an analytical approach can also be selected. For example, it is known that the evaporation of the water is a function of temperature and time. From the inking unit geometry, the printing speed and the assumption, for example, of a constant desired quantity of water on an ink applicator roll, the temperature dependence for the set-point change ΔW can be derived from this. A determination of this type of the temperature dependence can be carried out as a function of the printing speed D, in particular in order to determine the parameter ALTD of the mixed term T×D.

Once the functional relationship between the set-point change ΔW and the variables that influence the quantity of dampening solution in the printing process the closed-loop control can advantageously be carried out by means of a standard control method. The new set point for the controlled variable is therefore composed of the old set point W and the set point change ΔW In analogy with the procedure described, the method according to the invention can also be applied to the change in the set points, instead of to the set points themselves.

We claim:

1. A method for the closed-loop control of a quantity of dampening solution in a printing process, which comprises:

metering a quantity of dampening solution to be applied to a printing material in the printing process and adjusting the quantity in dependence on a first variable;

in addition to the first variable, taking into account at least one further variable influencing the requisite quantity of dampening solution in the printing process in the form of a set-point change ΔW as an input parameter for a dampening-solution controller.

2. The method according to claim 1, which comprises selecting the first variable as a printing speed of the printing process.

3. The method according to claim 1, wherein the at least one further variable comprises taking into account at least one variable selected from the group consisting of a printing speed, a temperature of an inking unit, a temperature of an ink fountain, a temperature of the ink, a type and a state of a printing plate, a number of prints made, an ink density, an elapsed printing time, a water absorption capacity of the ink, a concentration of dampening solution additives, and an ink strip width.

4. The method according to claim 1, which comprises taking into account the at least one further variable influencing the quantity of dampening solution in the printing process as a result of a measurement during the printing process.

5. The method according to claim 1, which comprises defining the set-point change $\Delta W$ as a polynomial expression in n variables up to an order q, wherein n and q are natural numbers, and n specifies the number of variables being taken into account.

* * * * *